US005255520A

United States Patent [19]

O'Geary et al.

[11] Patent Number: 5,255,520

[45] Date of Patent: Oct. 26, 1993

[54] ADVANCED THERMOELECTRIC HEATING AND COOLING SYSTEM

[75] Inventors: Daniel R. O'Geary; Larry D. Arnold, both of Albuquerque, N. Mex.

[73] Assignee: Refir Technologies, Albuquerque, N. Mex.

[21] Appl. No.: 811,325

[22] Filed: Dec. 20, 1991

[51] Int. Cl.[5] ..... F25B 21/02

[52] U.S. Cl. ..... 62/3.2

[58] Field of Search ..... 62/3.2, 3.3, 3.4, 3.6

[56] References Cited

U.S. PATENT DOCUMENTS

| | | | |
|---|---|---|---|
| 3,138,934 | 6/1964 | Roane . | |
| 3,834,171 | 9/1974 | Johanson | 62/3.2 |
| 4,280,330 | 7/1981 | Harris et al. . | |
| 4,476,685 | 10/1916 | Aid . | |
| 4,586,342 | 5/1986 | Morishita et al. | 62/3.6 |
| 4,744,220 | 5/1988 | Kerner et al. . | |
| 4,764,193 | 8/1988 | Clawson . | |
| 4,785,637 | 11/1988 | Giebeler . | |
| 4,799,358 | 1/1989 | Knopf et al. . | |
| 4,823,554 | 4/1989 | Trachtenberg et al. . | |
| 4,825,663 | 5/1989 | Nijjar . | |
| 4,848,090 | 7/1989 | Peters . | |
| 4,922,721 | 5/1990 | Robertson et al. . | |

OTHER PUBLICATIONS

Melcor Procedure for Assembly CP and FC (Type L) Lapped Modules.

Melcor Procedure for Assembling CP and FC Solderable Modules (Type TL) To Heat Exchangers.

Melcor Miniature Ceramic Modules Series FC.

*Primary Examiner*—John M. Sollecito

*Attorney, Agent, or Firm*—DeWitt M. Morgan

[57] ABSTRACT

A thermoelectric heating and cooling system which includes a load plate, one or more thermoelectric devices and a heat sink. The load plate includes a housing having a hollow cavity filled with a fluid which changes temperature slower than the load plate housing to thereby act as a sustaining phase change reservoir to help maintain the desired temperature on the load plate. Each thermoelectric device is separated from the heat sink by a spacer formed of material having high thermal conductivity. The spacers, in conjunction with material having low thermal conductivity which separates the load plate from the heat sink, forms a spacer duct for the passage of fluid between the load plate and the heat sink and around the spacers. A housing surrounds the exterior surfacer of the heat sink to form a heat sink duct for channeling fluid across the fins provided on the heat sink. The heat sink duct and the spacer duct are interconnected, whereby a single fan can force fluid through both. The system also includes a load plate duct which is interconnected with the heat sink duct and, hence, the spacer duct.

38 Claims, 9 Drawing Sheets

ADVANCED THERMOELECTRIC HEATING AND COOLING SYSTEM

BACKGROUND OF THE INVENTION

The fact that heat is absorbed or generated at the junction of two dissimilar metals carrying a direct current was discovered by Jean Claude Peltier over a century ago. The direction of current determines the direction of the heat flow toward or away from the junction. In simple terms, a Peltier device (also known as a thermoelectric device) is a heat pump.

Thermoelectric (Peltier) heat pump modules consist, essentially, of a pair of metalized ceramic plates (having high electrical insulation and excellent thermal conductivity properties) between which are sandwiched the desired number of N-type and P-type semiconductor couples. Typical materials used include antimony, lead, bismuth and tellurium. Such modules have been available from a number of manufacturers including MELCOR (Materials Electronic Products Corporation, Trenton, N.J.) for decades. Typically, they have been promoted as performing the same cooling functions as freon based compression or absorption refrigerators and, according to MELCOR, have used or proposed for a wide range of thermal management applications in the following areas:

Military/Aerospace: Inertial guidance systems, military aircraft, electronic equipment cooling, parametric amplifiers, and portable refrigerators.

Laboratory & Scientific Equipment: Infrared detectors, photomultiplier tube housing coolers, lasers, diodes, transistors, integrated circuit coolers, vidacon tube coolers, laboratory cold plates, cold chambers, stir coolers, immersion coolers, ice point reference baths, microtome stage coolers, electrophoresis cell coolers, osmometers, dewpoint hygrometers, air pollution control analyzers, tissue processing refrigerators, oil pour point apparatus, constant temperature baths, and thermostat calibrating baths.

Consumer Products: Recreation vehicle refrigerators, mobile home refrigerators, portable picnic coolers, wine coolers, beer keg coolers, and aquarium coolers.

Mobile Refrigerators: Medical, pharmaceutical, and food service.

Restaurant Equipment: Cream dispensers, butter dispensers, and display case coolers.

Medical Instruments: Hypothermia blanket chillers, opthomological cornea freezers, blood analyzers, and tissue preparation and storage.

Beverage Coolers: Aircraft water coolers, wine coolers, cream dispensers, and beer keg coolers.

Various refrigeration/heating devises using thermoelectric modules are disclosed in a considerable number of U.S. patents including:

U.S. Pat. No. 4,744,220 to J. M. Kerner et al. for an under sink water heating and/or cooling system, with a liquid cooled heat exchanger (see FIG. 4.A.)

U.S. Pat. No. 4,476,685 to J. D. Aid directed to apparatus for heating or cooling blood and blood plasma.

U.S. Pat. No. 4,848,090 to A. C. Peters for maintaining the temperature of an integrated circuit under test.

U.S. Pat. No. 4,922,721 to W. M. Robertson, et al. for a mobile storage compartment with a thermoelectric cooling system.

U.S. Pat. No. 4,823,554 to L. Trachtenberg, et al., directed to a portable thermoelectric heating and cooling food container adopted for use in a vehicle.

U.S. Pat. No. 4,799,358 to U. C. Knopf et al. for a device for cooling and deep freezing samples of a biological material with layered Peltier cooling elements (at least two cooling layers containing blocks of Peltier elements, alternating with plates of heat conducting metal, preferably aluminum).

U.S. Pat. No. 4,764,193 to L. G. Clawson for thermoelectric frost collectors for freezers.

U.S. Pat. No. 4,785,637 to R. Giebeler which relates to thermoelectric cooler with improved heat dissipation (see bottom of column 3 and top of column 4).

Despite the fact that the Peltier effect has been known for over a century, to applicants' knowledge thermoelectrics have never been utilized in vehicle cooling systems, which today remain freon based. Even, in the case of truck tractors, where auxiliary heating/cooling systems have been proposed or used when the main engine is off, such auxiliary systems utilize an auxiliary fossil fuel burning engine and the tractors' existing freon based system. See, for instance, U.S. Pat. No. 4,825,663 to P. S. Nijjar.

Auxiliary systems such as disclosed by Nijjar have a number of drawbacks including fossil fuel depletion, use of freon, environmental pollution and engine wear and tear. Environmental pollution includes the release of freon (which seriously damages the ozone layer), hydrocarbons and other exhaust emission pollutants into the atmosphere, and noise pollution.

Thermoelectric based vehicle air conditioning systems (whether truck tractor, truck or passenger car) for selectively heating and cooling the passenger compartment thereof are disclosed in U.S. Pat. No. 4,280,330 to V. Harris et al. and U.S. Pat. No. 3,138,934 to A. E. Roane. The systems disclosed therein are, in applicants' opinion, impractical, probably won't work and have not been commercialized. In the case of Harris et al., there is no mention of the heat leak characteristics of the vehicle in question, or the heat load, or of varying the heating and cooling as to comfort. More importantly, the design of the thermoelectric configuration is not specified, with only a general reference to interior and exterior heat sinks. Further, there is no current limiting circuitry, without which the thermoelectric device or devices (the number is not specified) will run away. Finally, thermoelectrics are linear devices, not digital, and need to operate by linearly increasing or decreasing current, not by using a thermostat which opens and closes a circuit turning the thermoelectric device either off or on. Roane is similarly defective.

Despite the disclosures in these two patents and the numerous other uses/proposed uses for thermoelectric modules, applicants are not aware of any thermoelectric vehicle heating/cooling system which has been commercialized. As indicated above, the designs which applicants' are aware of are impractical and probably won't work. Further, up until now freon has been the refrigerant of choice.

In view of the foregoing, it is the general objective of the present invention to provide a CFC-free air conditioning system that effectively conditions (heats or cools) a given volume of air (such as a room or cab of a truck tractor) to a preselected temperature, maintains the preselected temperature for protracted periods of time, with low electrical power requirements, where the heat generated is rapidly transported from the Peltier junction, and which reduces the drawbacks which result from the transmigration of thermal energy.

It is also the objective of the present invention to:

Provide a thermoelectric heating and cooling system in which the load plate includes a hollow metal housing which is filled with a liquid, such as water or mixture of water and ethyl alcohol, which resists rapid changes in temperature to sustain the heating (or cooling, depending on the direction of current through the thermoelectric modules) effect.

Provide a thermoelectric heating and cooling system with metal spacers between the thermoelectric modules and the heat sink to provide an initial heat removal stage before the thermal energy reaches the primary heat sink for final dissipation.

Provide a thermoelectric heating and cooling system where passages are provided for cooling and heating both the metal spacers and the heat sink and wherein such passages are interconnected.

Provide a thermoelectric heating and cooling system with ducts for both the load plate and the heat sink and wherein the ducts are interconnected by an opening such as a venturi.

In the case of vehicle heating/cooling systems, additional objectives include:

Reduction of fossil fuel consumption.

Reduction of air pollution.

Reduction of noise pollution.

Reduce and in some cases eliminate use of freon.

Reduction of engine wear and tear and resultant downtime.

These and other objectives are achieved by the invention disclosed and claimed herein.

SUMMARY OF THE INVENTION

A thermoelectric heating and cooling system which includes a load plate, one or more thermoelectric devices and a heat sink. The load plate includes a housing having a hollow cavity filled with a fluid which changes temperature slower than the load plate housing, to thereby act as a sustaining reservoir to help maintain the desired temperature on the load plate. Each thermoelectric device is separated from the heat sink by a spacer formed of material having high thermal conductivity. The spacers, in conjunction with material having low thermal conductivity which separates the load plate from the heat sink, form a spacer duct for the passage of fluid between the load plate and the heat sink and around the spacers. A housing surrounds the exterior surfaces of the heat sink to form a heat sink duct for channeling fluid across the fins provided on the heat sink. The heat sink duct and the spacer duct are interconnected, whereby a single fan can force fluid through both. The system also includes a load plate duct which is interconnected with the heat sink duct and, hence, the spacer duct.

DESCRIPTION OF THE PREFERRED EMBODIMENTS

Figure 1:
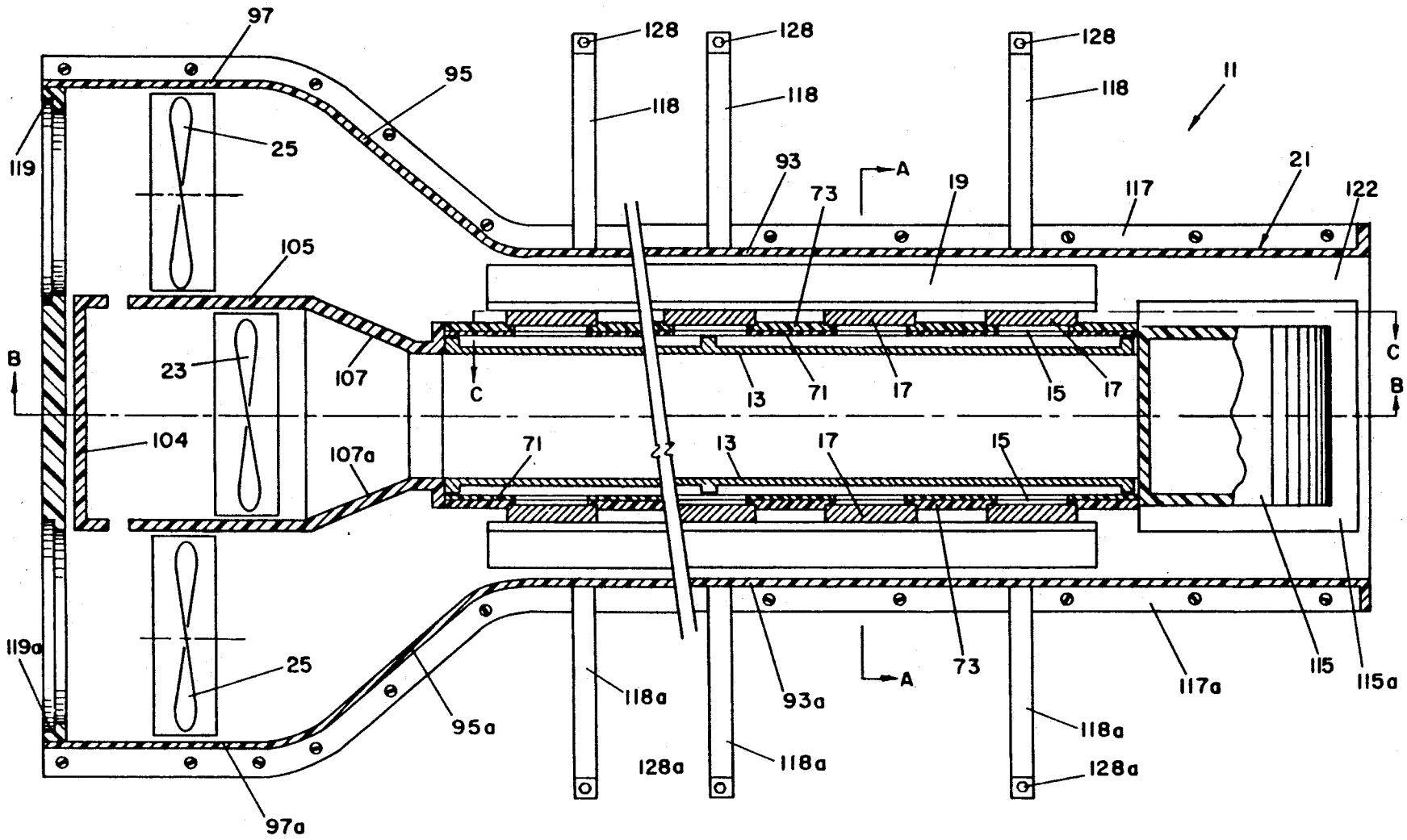
FIG. 1 is a top sectional view of one of the preferred embodiments of the invention with the load plate fins removed.
Figure 2:
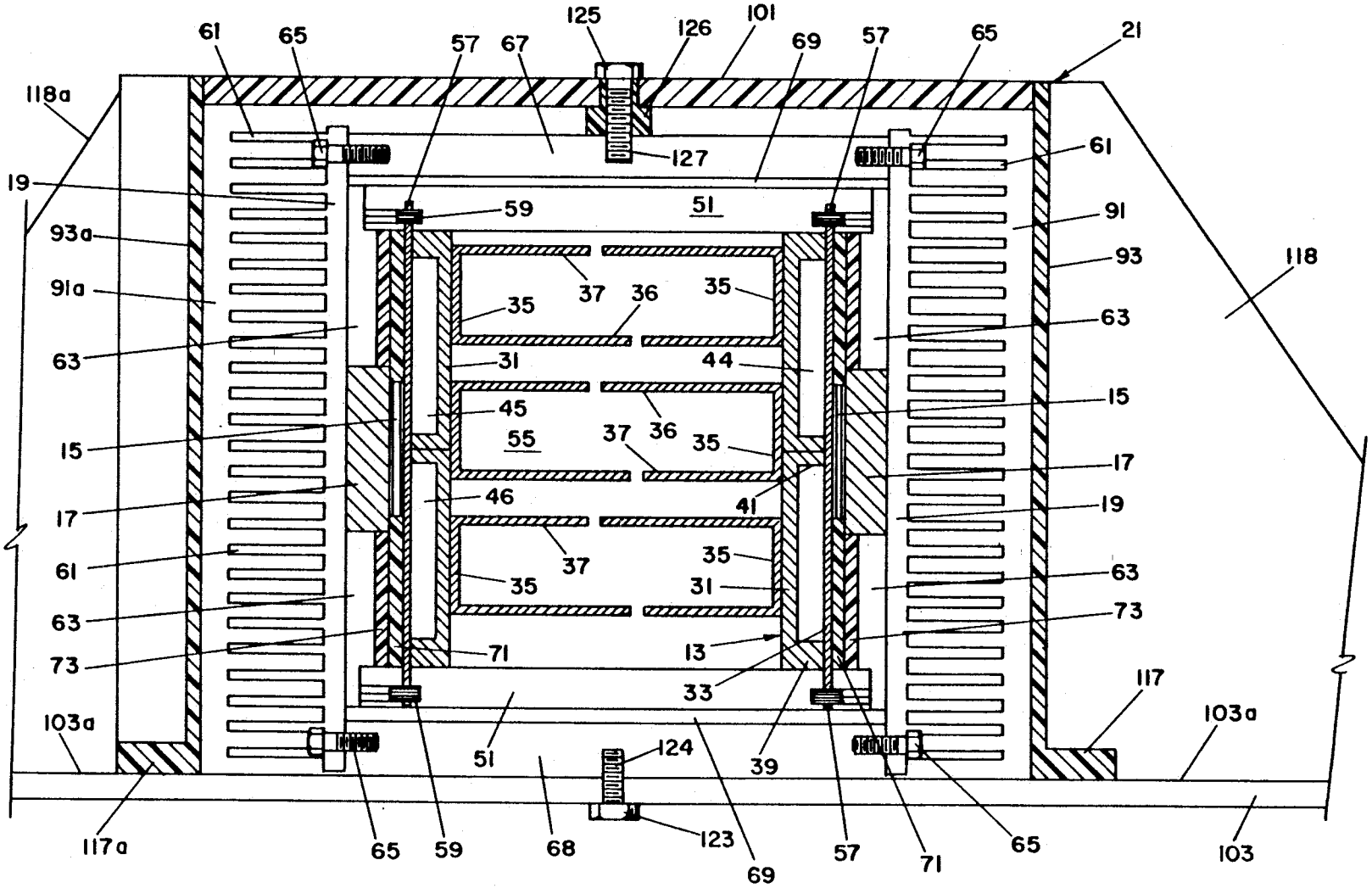
FIG. 2 is a view of the embodiment of FIG. 1, taken along lines A—A.

As is evident from, particularly FIGS. 1 and 2, thermoelectric heating/cooling system 11 includes a pair of load plates 13, ten thermoelectric-modules 15, ten heat sink spacers 17, a pair of heat sinks 19, an exterior housing 21, load plate duct fan 23 and heat sink duct fans 25. Thermoelectric modules 15 are, preferably MELCOR® model CP 1.0-127-05L-1, or equivalent.

Figure 5:
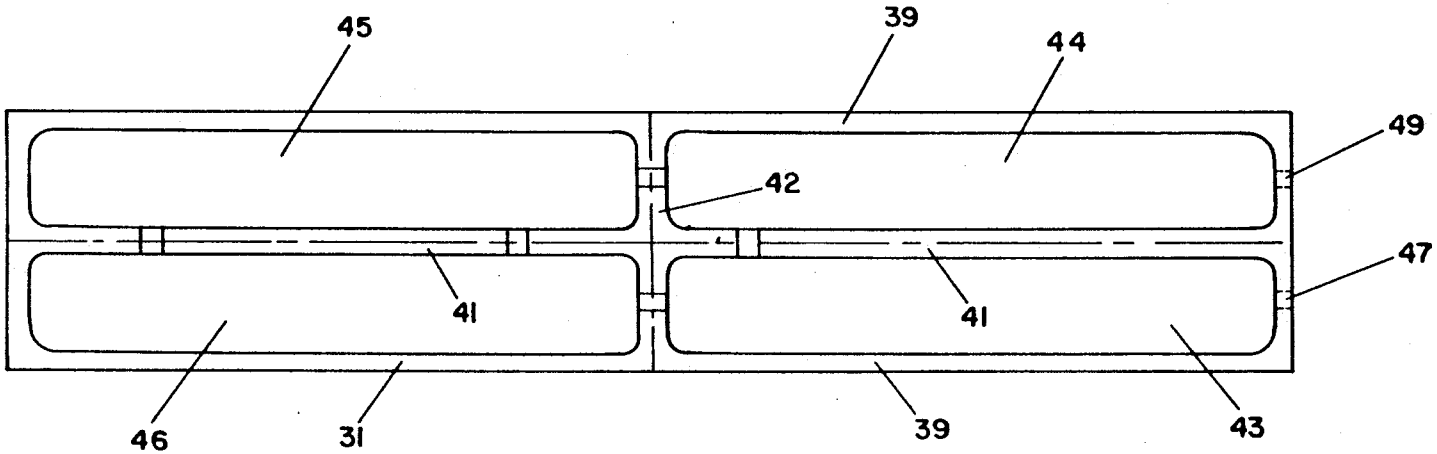
FIG. 5 is a top plane view of the load plate of the first embodiment, with its cover removed to show the liquid reservoirs and supporting structure.
Figure 6:
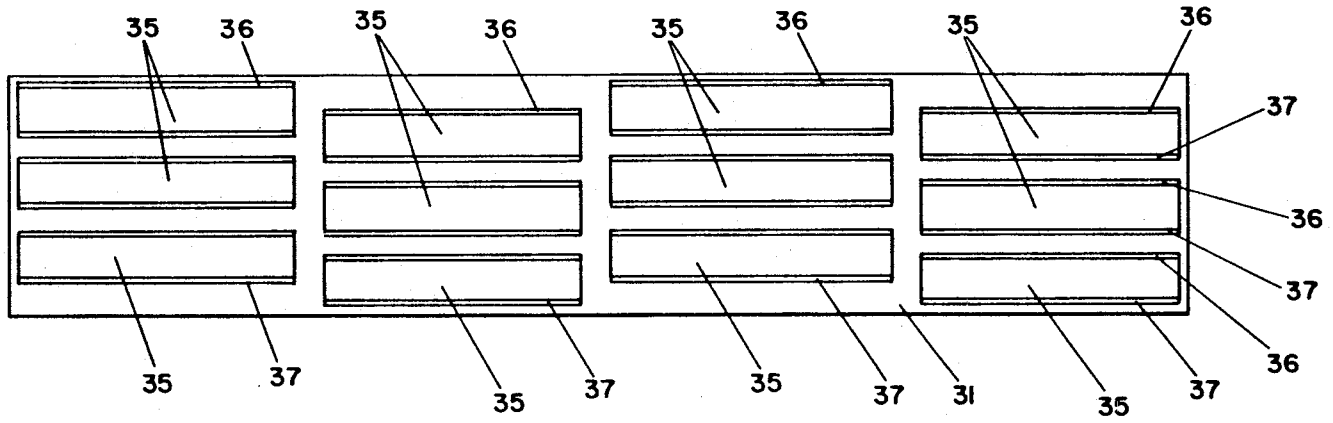
FIG. 6 is a bottom view of the load plate showing the positioning of the heat transfer fins.

With reference to FIGS. 2, 5 and 6, each load plate 13 includes a base plate 31, a cover 33 and a plurality of U-shaped thermal transmission fins 35. Each fin 35 has a long leg 36 and a short leg 37 which project into load duct 55 to maximize the surface area exposed to the air passing there through to maximize heat transfer. Preferably, base plate 31, cover 33 and fins 35 are made of copper, though other materials having high thermal conductivity may be substituted therefor. Base plate 31 includes a continuous exterior shoulder 39 and a pair of internal support ribs 41 and 42, all of the same height, which when assembled with cover 33, form four cavities 43, 44, 45 and 46. Cavities 43, 44, 45 and 46 are interconnected via openings 46*a*. External access to the cavities 43 and 44 is via passages 47 and 49 which, in operation, are closed by No. 6-32 set screws or other suitable plugs or valves. Plate 33 is silver soldered to base 31 to insure high thermal contact therewith and that the four cavities are sealed. Similarly, fins 35 are silver soldered to base plate 31. Preferably cavities 43, 44, 45 and 46 are filled with a mixture of distilled water and ethyl alcohol to provide a phase change medium. Alternately, under certain system designs and operating temperatures other phase change liquids may be used. With both passages 47 and 49 open, the cavities are filled with a syringe inserted through one. When totally filled, including passages 47 and 49, the set screws are inserted to the point they project into cavities 43 and 44 to slightly pressurize the fluid. In operation, the function of the fluid in the cavities is analogous to a large, mechanical flywheel, where the inertia of the flywheel sustains the work performed with, in many cases, a decreased power requirement.

Load plates 13 are held in assembled relation with each other, as best illustrated in FIG. 2, by a pair of rectangular plates 51 to form heat transfer or load duct 55. Plates 51 are secured to the lip portions 57 of cover plates 33 by suitable fasteners, such as snap pins 59. Plates 51 are made of polypropylene or other suitable rigid, dense insulating material having a low thermal conductivity or "k" factor.

Figure 4:
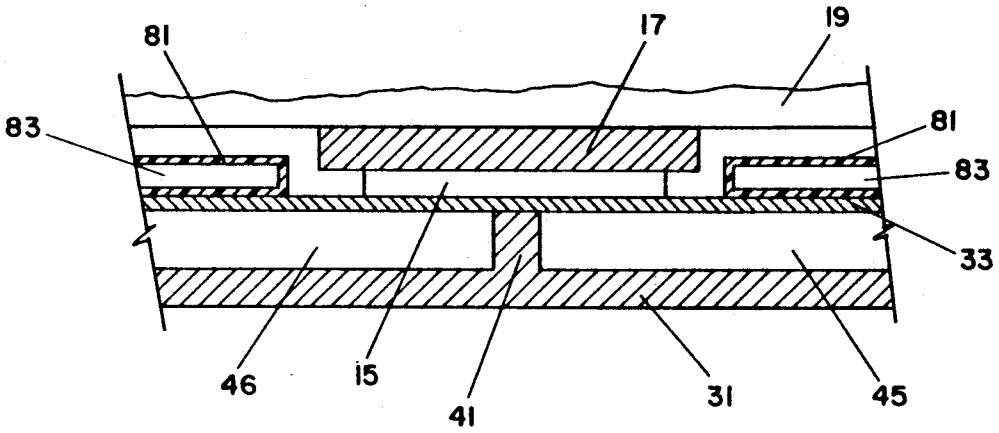
FIG. 4 is an enlarged detail of the load plate, thermoelectric module, heat sink spacer, and heat sink of the embodiment of FIG. 1, with an alternate insulation layer on the load plate.
Figure 3:
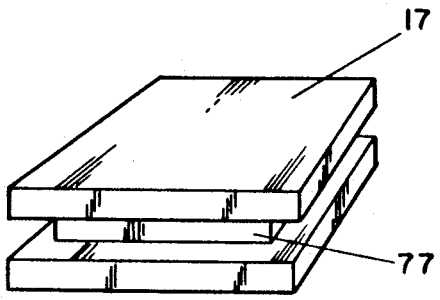
FIG. 3 is a perspective drawing of the heat sink spacer of the present invention.

With particular reference to FIGS. 2, 3 and 4, the specifics of the thermal coupling between load plate 13, thermoelectric module 15, heat sink spacer 17 and heat sink 19 are illustrated. Each thermoelectric module 15 is secured to cover plate 33 of load plate 31 by a heat transfer compound, such as "Type 44", and compression, as explained below. Mechanically and thermally interconnecting each thermoelectric 15 with heat sink 19 is a heat sink spacer 17. Spacer 17, which is secured to heat sink 19 via Type 44 heat transfer compound and snap pins (not shown) or other suitable fasteners, is formed of copper or other suitable high thermally conductive material. Type 44 transfer compound is also used on the mating surfaces of the thermoelectrics 15 and heat sink spacers 17.

Figure 9:
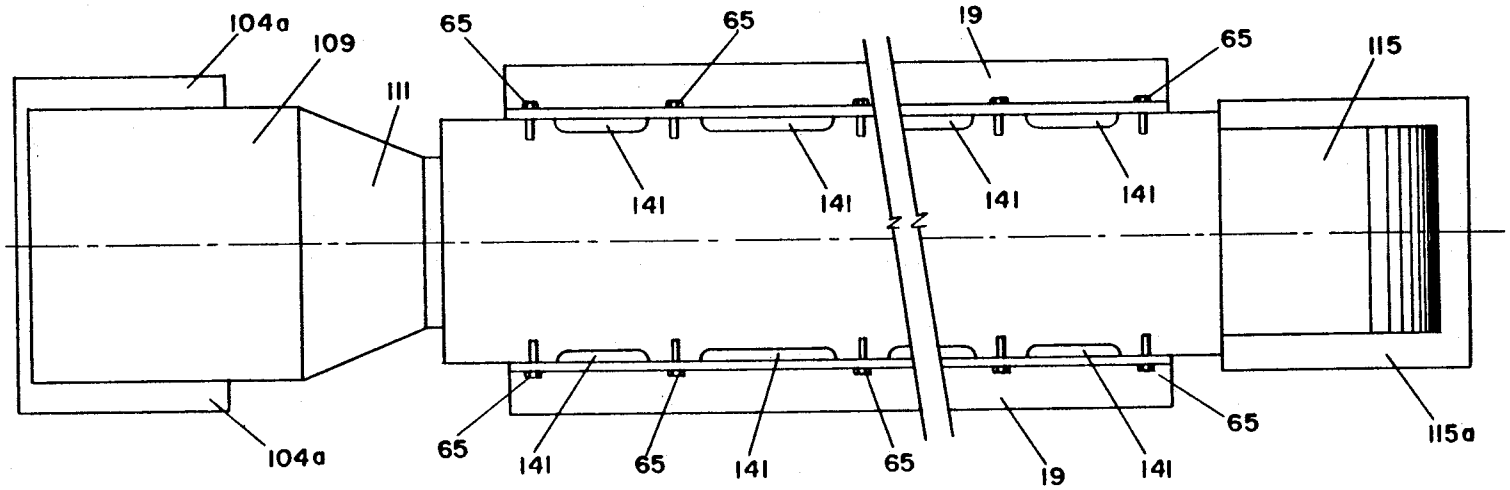
FIG. 9 is a top view of the load plate and heat sink module of the embodiment of FIG. 1.

Each heat sink 19 is formed of aluminum, or other high thermal conductive material, and includes a plurality of thermal radiating fins 61. To hold heat sink spacers 17 in good thermal contact with the thermoelectric modules 15 and also to form heat sink spacer ducts 63, both heat sinks 19 are bolted via screws 65 (or otherwise secured) to a pair of rectangular plates 67 and 68 to form an open ended box-like structure. Typically plates 67 and 68 may be formed of polypropylene, or other material having similar low thermal conductivity. As is evident from FIG. 2, this box like structure surrounds the open ended box-like structure formed by load plates 13 and plates 51. To provide additional insulation, rectangular sheets of polystyrene 69 or other insulative material are interposed between each pair of plates 51 and 67, and 51 and 68. The spacing between opposing lips 57 on load plates 31 and between opposing heat sinks 19 is such so as to insure that, when assembled, thermoelectric modules 15 are held under compression between heat sink spacers 17 and cover plate 33. As is evident from FIGS. 2 and 9, each heat sink 19 is secured to plates 67 and 68 by twelve ¼-20 screws 65; six along the top, six along the bottom. By torquing screws 65 to, approximately 10 in-lbs, the desired compression on thermoelectric modules 15 is achieved.

With reference to FIG. 2, cover plate 33 of load plate 13 is substantially insulated from spacer duct 63 via a first layer 71 of polystyrene and a second layer 73 of polypropylene. Layer 73 is of polypropylene to reduce the drag on air passing through duct 63.

Figure 8:
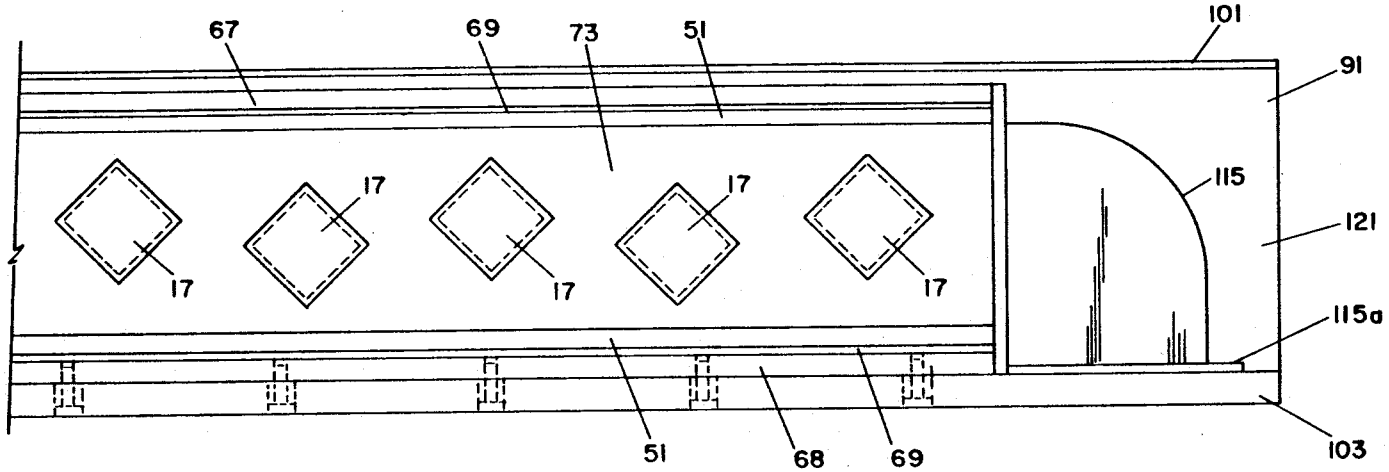
FIG. 8 is an additional sectional view of the embodiment of FIG. 1, taken along lines C—C.

With reference to FIG. 3, it will be seen that each heat sink spacer 17 is provided with a circumferential groove 77 which substantially increases the surface area of spacer 17 that is exposed to duct 63 and, hence, the air flowing through duct 63. With reference to FIG. 8, it will be seen that spacers 17, and hence thermoelectric modules 15, are not in line with respect to the air flow, but staggered. As set forth below, in conjunction with FIGS. 8 and 9, this arrangement permits better air circulation around spacers 17.

To provide even greater thermal insulation between plate 33 and duct 63, layers 71 and 73 may be replaced by a hollow insulating plate 81, as illustrated in FIG. 4. Closed cavity 83 formed within plate 81 is filled with, for instance $CO_2$, which has a thermal conductivity of 0.0084. Other gases having low thermal conductivity, such as nitrogen, may also be used. Carbon Dioxide is preferred because it is readily available and inert. Cavity 83 is divided into a number of internal but interconnected compartments via internal stiffening ribs (not shown). Access to cavity 83, to permit filling, is via a one way valve (also not shown).

As is particularly evident from FIG. 2, and with reference to FIGS. 1, 7, 10 and 11, housing 2 surrounds heat sinks 19 to form heat sink duct 91, **91*a*. The exterior of ducts 91, 91*a* is formed by a pair of side plates defined by sections 93, 93*a*, 95, 95*a*, 97, 97*a*, front end plate 99, and top plate 101. The interior of duct 91, 91*a* is defined by surface 103*a* of the base 103 to which housing 21 and plate 68 are secured, as well as plates 104, 105, 105*a*, 107 and 107*a*, load plate duct cover plates 109, 111, and 113, the fins 61 and other exterior surfaces of heat sinks 19, and load plate duct housing 115. Sections 93, 93*a*, 95, 95*a*, 97, 97*a* and 99 are, typically, formed of polypropylene or other suitable similar material. While these sections can be individually fabricated and then bonded together, preferably they are molded as an integral unit, together with lips 117, 117*a* and gussets 118, 118*a*, as illustrated. Plates 104, 105, 105*a*, 107, 107*a*, 109, 111 and 113 are, preferably, also made of polypropylene. While these pieces may also be individually fabricated and then assembled, for production purposes they would be molded as a unit with a lip 104*a*. Housing 115, also fabricated of polypropylene, includes an integral mounting lip 115*a*. Front end plate 99 includes a pair of circular air intake openings 119**.

Figure 11:
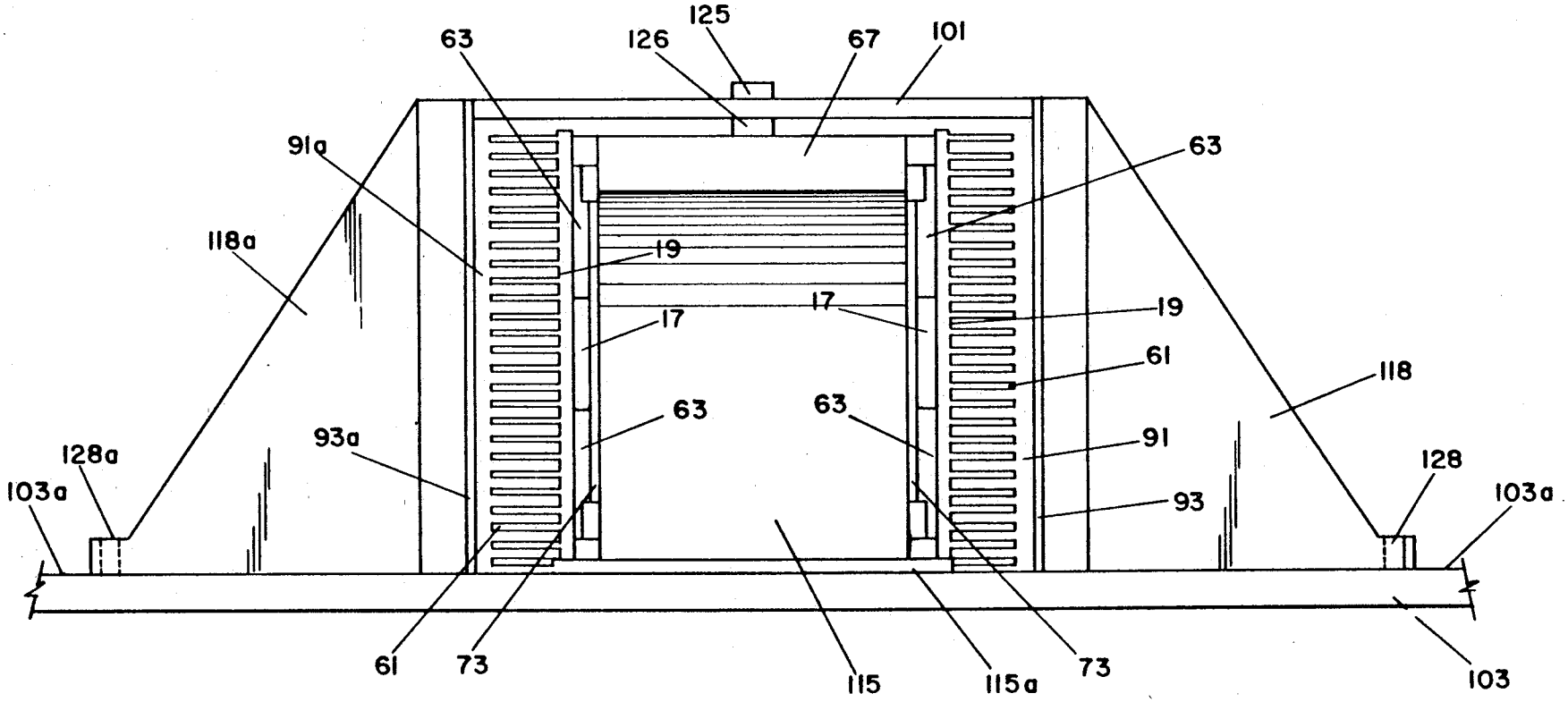
FIG. 11 is the opposite end view of the embodiment of FIG. 1.

To insure that system 11 is securely attached to base 103 and does not rock, plate 68 is secured to surface **103*a* via a plurality of screws 123 received in tapped holes 124, as illustrated in FIG. 2. Plate 67 is also secured to top plate 101 via a plurality screws 125, which pass through spacers 126 and are received in tapped holes 127. As illustrated in FIGS. 1 and 11, the outer ends of gussets 118 and 118*a* are provided with holes 128, 128*a*, through which pass screws (not shown) for securing the gussets to base 103. Finally, lips 117, 117*a* are held in engagement with surface 103*a*** by a plurality of machine screws (also not shown).

Again, with reference to FIG. 1, heat sink duct fans 25 are positioned adjacent to air intake openings 119 to draw air from the outside environment and onto heat sink ducts 91 and **91*a*. In the preferred embodiment, fans 25 are 118 cubic feet per minute (CFM) fans, capable of delivering static flows of 1500+ feet per minute (FPM). Such fans are, preferably, of the tube axial type manufactured by ebm Industries, Inc. of Farmington, Conn. As the cross-sectional area of ducts 91, 91*a* decreases, due to the Bernoulli shaped passage formed by plates 95, 107 and 95*a*, 107*a*, the velocity of the air flow increases. After passing over fins 61, the air exits to the outside environment through exhaust 122**.

As is also apparent from FIG. 1, air from fans 25 not only is forced over fins 61 of heat sinks 19 but is forced into spacer ducts 63, where plates 107, **107*a* join insulation layers 71, 73, and then around the exposed edges of heat sink spacers 17 to transfer thermal energy between the air in ducts 63 and spacers 17. Thus, the spacer duct 63 functions as the first phase of heat transfer relative to thermoelectric modules 15 (depending on the polarity of the current therethrough). In the case where the air in load duct 55 is being cooled, the air flowing through ducts 63 removes about 15% of the heat which would normally be transferred to heat sinks 19. This permits the use of smaller heat sinks, as well as the ability to remove more heat faster. With regard to heating the air in load duct 55, venturis 131 and 131 in plates 105, 105***a* (discussed in greater detail in conjunction with FIG. 12) allow warm (internal environment) air to mix with the external (ambient) air to permit warming of spacers 17 and heat sinks 19. As thermoelectric modules 15 are heat pumps, they take heat from one area and place it in another area. The above described venturi duct configuration applies to both heating and cooling.

Figure 7:
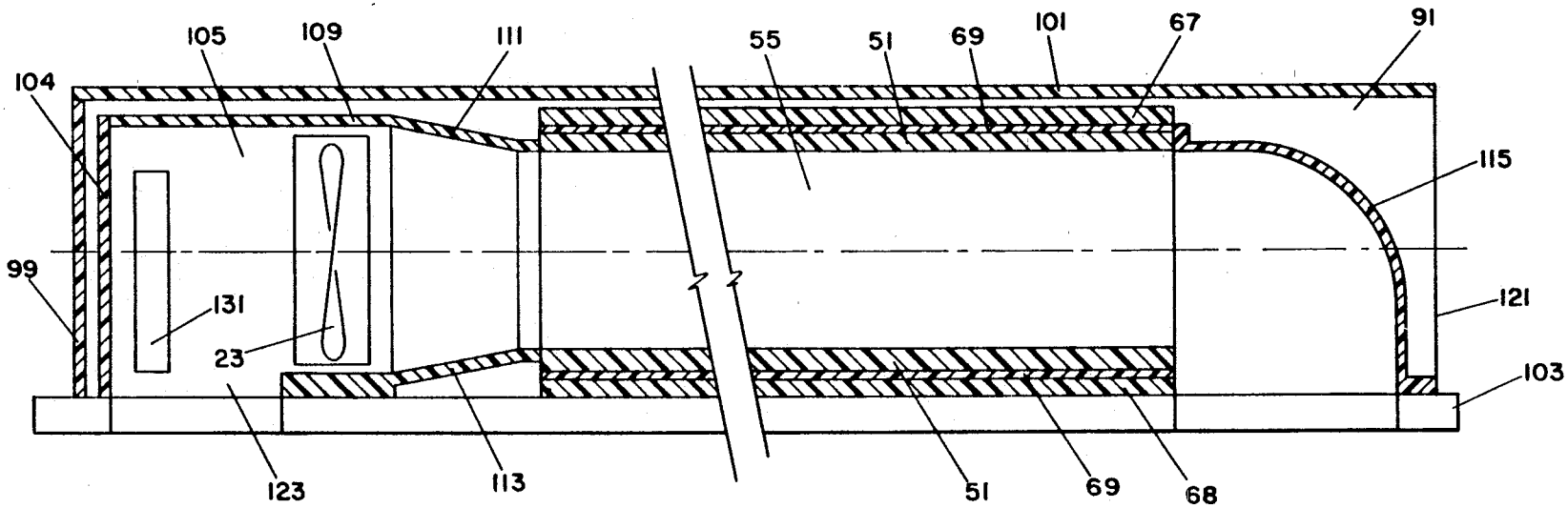
FIG. 7 is a sectional view of the embodiment of FIG. 1, taken along lines B—B.

Load duct 55 is coupled to the closed environment to be controlled, by an input duct 123 (defined by plates 104, 105, 105*a*, 107, 107*a*, 109, 111 and 113) and by output duct 115 See FIGS. 1 and 7. Positioned within duct 123, just prior to the Bernoulli shaped passage formed by plates 107, 107*a*, 111 and 113, is fan 23, which is also manufactured by ebm Industries, Inc. Typically, it has same specifications as fans 25. Air from the closed environment is drawn in duct 123, forced over fins 36, 37 and back into the closed environment via duct 115.

Figure 12:
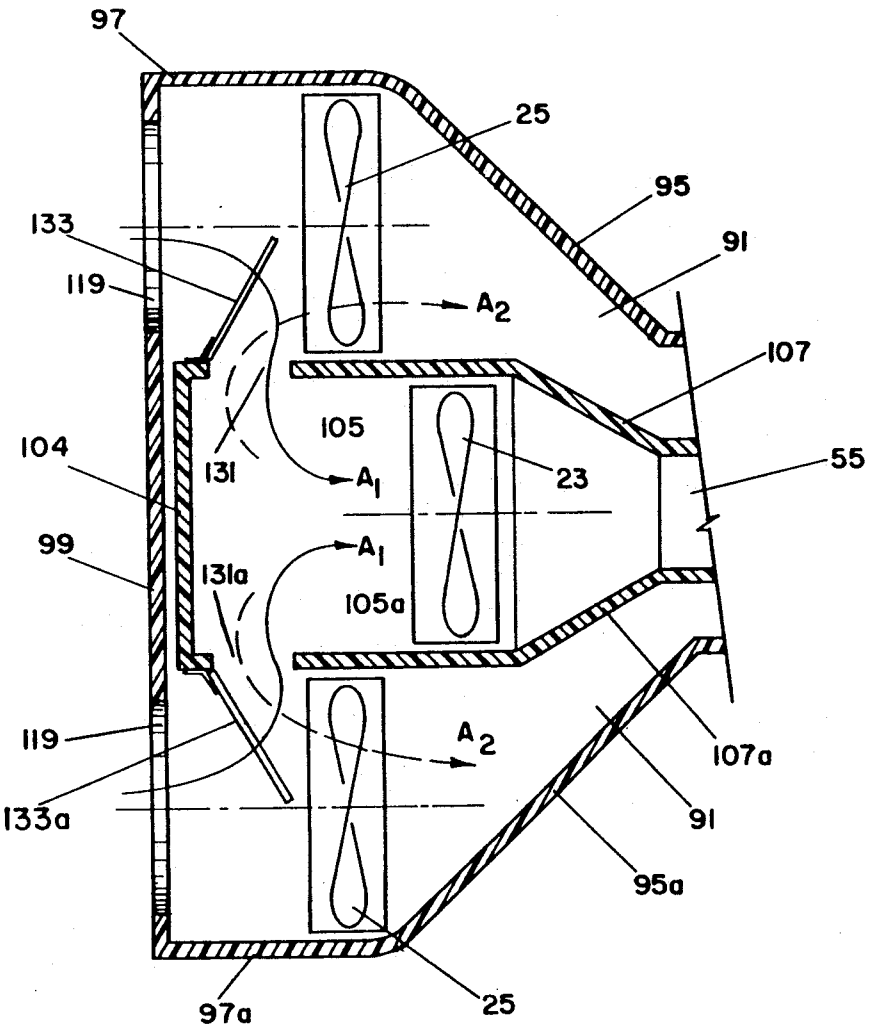
FIG. 12 is an enlarged sectional view of the deflector plate and the fluid interconnection between the primary duct and the heat sink ducts.
Figure 10:
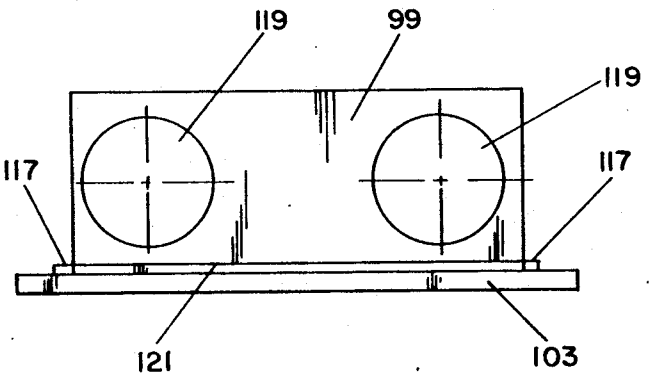
FIG. 10 is the front end view of the embodiment of FIG. 1.

With reference to FIG. 12 it will be apparent that heat sink ducts 91, 91*a* are not totally isolated from load plate duct 55. Each of plates 105, 105*a* is provided with an elongated rectangular slot 131, 131*a*, which are modified venturis, adjacent to which are attached deflector plates 133, 133*a*. As indicated by the solid arrow, $A_1$, when fan 23 is running faster than fans 25, ambient (outside) air is drawn from ducts 91, 91*a* through slots 131, 131*a* and into load plate duct 55. However, when fans 25 are running faster than fan 23, air from the closed environment is drawn across both the heat sink fins 61 and the spacers 17, as indicated by the broken lines $A_2$.

In operation, the most significant problem is the dissipation of heat when the air in the closed environment is to be cooled. First fans 25 are energized. This, as explained in reference to FIG. 12, draws some air out of the closed environment through slots 131 and 131*a*, which air mixes with the ambient air being drawn in through air intake openings 119. The arrangement allows for a pre-cooling of heat sinks 19 and heat sink spacers 17, as well as producing a small convection air flow through load duct 55. After fans 25 have been running approximately 30 seconds, thermoelectric devices 15 are energized. Once the thermoelectric devices 15 have cooled to, approximately, 36° F., fan 23 is energized to draw air in from the closed environment and force it through load plate duct 55 for cooling.

To maintain a particular temperature, current to thermoelectric devices 15 is increased or decreased relative to the baseline associated with that temperature (e.g., 15 amps $\approx$ 65° F.). We have found that if current to a thermoelectric device is quickly reduced the $I^2R$ heat generated by the current passing through such thermoelectric device cannot be as quickly removed as it was with the higher current (i.e., Joule heating). Thus, a transmigrational warming of thermoelectric devices 15 occurs, which warming returns load plates 31 back up to the particular temperature set. Thus, it is not necessary to reverse the polarity of the thermoelectric devices. If too much warming occurs, current is then increased to cool load plates 31.

In the event the total heat load of the closed environment on load plates 31 is greater than load plates 31 and thermoelectric devices 15 can handle (as, for instance, when the outside temperature is very hot), fan 23 slows down to, for instance, three-quarter speed, then to half speed if necessary. This allows both load plates 31 and thermoelectric devices 15 to recover, by passing less air over fins 36 and 37. The lower speed of fan 23 in conjunction with the higher speed of fans 25 also allows some air from the closed environment to be drawn into ducts 91, 91*a* and across both heat sinks 19 and spacers 17. Once load plates 31 and thermoelectric devices 15 have recovered, fan 23 returns to its normal operating speed.

With regard to the thermodynamics of the cooling mode, transfer of heat from the load plate side of thermoelectric devices 15 to the heat sink spacers 17 is rapid. Spacers 17 and spacer ducts 63 provide for a first stage heat removal. The geometric shape of spacers 17 and the provision of grooves 77 maximizes the surface area. The staggered arrangement as illustrated in FIG. 8, together with exit ports 141 provided in plate 67 (see FIG. 9), and matching exit ports (not shown) in adjacent sheet 69, maximizes the air flow around spacers 17 and the heat transfer. Heat transfer, from spacers 17 and the air passing through ducts 63, back to load plate 31 is minimized by insulation 71 and 73. The smooth exposed surface of insulators 73 reduces the drag on the air passing through ducts 63. The heat remaining in spacers 17 is transferred to heat sinks 19, which is removed by the air flowing through ducts 91 and 91*a* and passing over fins 61. Preferably the heat sinks are designed to transfer 0.09° C./watt. As those skilled in the art will appreciate, the higher the velocity of the air passing over fins 61 the more rapid the heat removal. Velocity is affected by the type and speed of fans 25, as well as the shape of the Bernoulli formed by ducts 91 and 91*a*. The more rapid the heat removal, the greater the efficiency of the heat transfer system (i.e., thermoelectrics 15, spacers 17, and heat sinks 19). This, in turn, translates into a reduced energy requirement for powering the thermoelectrics 15 and, therefore, a reduced energy cost to the user.

To heat air passing through load plate duct 55, a manual switch (not shown) reverses the polarity of thermoelectrics 15. Alternately, via sensors (not shown) and a switching system (also not shown) the thermal condition of the environment is monitored and the polarity of thermoelectrics 15 set accordingly.

For heating both fans 25 and fan 23 are energized at full speed; thermoelectrics 15 are energized at full power. When the set thermal condition is reached the sensor signals the switching system and the current and voltage to the thermoelectrics are reduced. If heat sinks 19 get too cold, fan 23 is slowed down to allow more warm air to be drawn through venturis 131, 131*a* and into heat sink ducts 91 and 91*a*. When heat sinks 19 return to the desired temperature, the speed fan 23 is returned to its normal setting.

Figure 13:
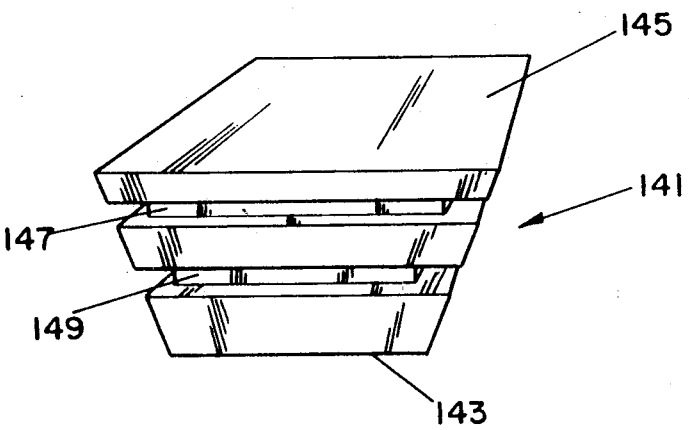
FIG. 13 is a perspective drawing of an alternate heat sink spacer of the present invention.

With reference to FIG. 13, an improved heat sink spacer 141 is illustrated. Spacer 141 includes a square base 143 which is the same size and shape as the mating surface of thermoelectric device 15. Heat sink base 145 is also square, but larger in area than base 143 to give spacer 141 a trapezoidal cross-section. Finally, spacer 141 includes a pair of circumferential grooves 147 and 149 to increase the surface area that is exposed to air passing through spacer ducts 63. This spacer design provides for total coverage of the top surface of each thermoelectric device 15, without the overhang such as illustrated in FIGS. 1 and 2, while maximizing the surface area in contact with heat sinks 19. Overall spacer mass is also increased to further reduce the thermal energy transfer between spacer 141 and heat sink 19.

Figure 15:
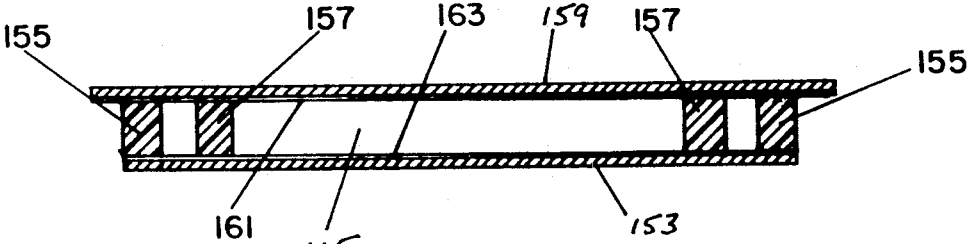
FIG. 15 is a sectional view of the load plate of FIG. 14, taken along lines D—D.
Figure 14:
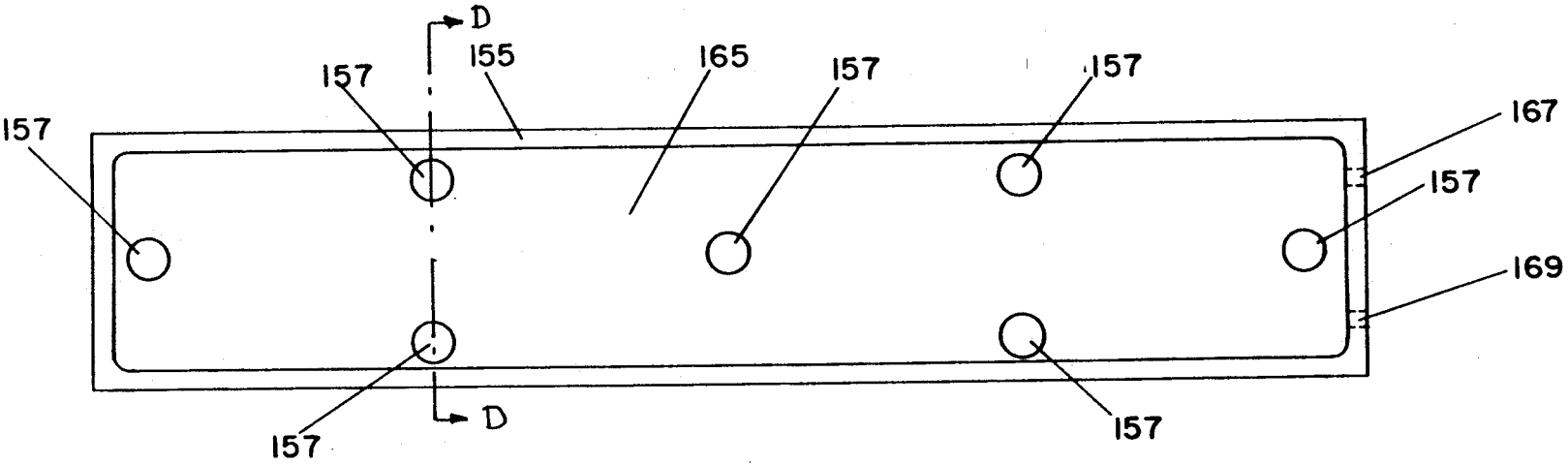
FIG. 14 is a top plane view of an alternate load plate for the first embodiment, with its cover removed to show the reservoir and supporting structure.

We have also determined that, with the load plate design illustrated in FIGS. 1, 2 and 5, all the thermoelectric devices 15 are, via cover plate 33, in contact with copper support rib 41. With this arrangement, most of the thermal energy transferred between fins 35 and the thermoelectric devices 15 is through rib 41 and not through the phase change medium. To maximize the effect of the phase change medium, alternate load plate 151, illustrated in FIGS. 14 and 15, may be utilized. Load plate 151 includes a base plate 153 to which copper fins (not shown) are silver soldered. Load plate 151 also includes a continuous exterior spacer 155, a plurality of interior spacers 157, and a top plate 159 which has the same dimensions as cover plate 33. Plates 153 and 159 are both of copper and are secured to spacers 155 and 157 via suitable adhesive layers 161 and 163 to form interior chamber or cavity 165. When assembled with rectangular plates 51, plates 67 and 68 and heat sinks 19, in the manner illustrated in FIG. 2, plates 153 and 151 are also held in compression. Spacers 155 and 157 are, preferably, made of vulcanized rubber or equivalent dense elastic material having low thermal conductivity. Typically cavity 165 is filled in the same manner and with the same phase change medium as cavities 43, 44, 45 and 46. For this purpose, spacer 153 also includes a pair of openings 167 and 169 which function in the same manner as passages 47 and 49. The use of elastic material allows for some expansion of cavity 165.

Figure 17:
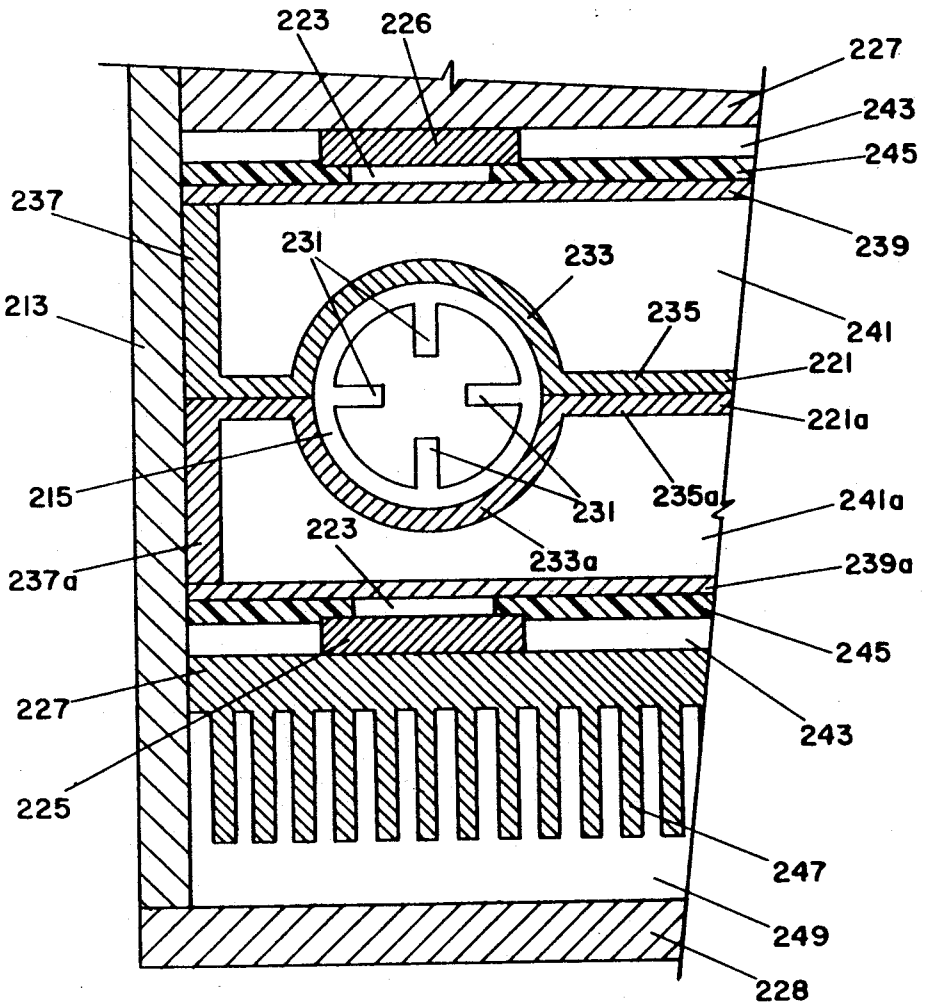
FIG. 17 is a partial sectional view of the embodiment of FIG. 16.
Figure 16:
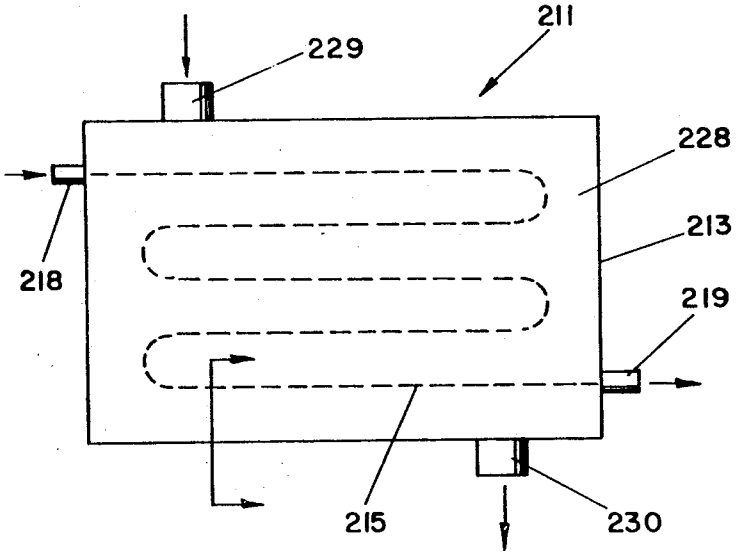
FIG. 16 is a top plain view of an alternative embodiment.

With reference to FIGS. 16 and 17, $CO_2$, thermoelectric cooling system 211 is illustrated. System 211 includes an exterior housing 213, and load tube 215, load tube input 217 and output 219. Load tube 215 is sandwiched between a pair of load plates 221, 221*a*, to which are secured thermoelectric devices 223, heat sink spacers 225 and heat sinks 227. Housing 213 includes covers 228, heat sink input 229, and heat sink output 230.

Tube 215 includes a plurality of inwardly projecting fins 231, which function in a manner analogous to fins 35, to maximize the internal surface area which is exposed to the $CO_2$ which passes therethrough. Load plate 221 and 221*a* include: mating semi-circular recesses 233, 233*a*; mating planar surfaces 235, 235*a*; peripheral shoulders 237, 237*a*; internal supporting ribs (not shown); and cover plates 239, 239*a*. Plates 239, 239*a* are silver soldered to shoulders 237, 237*a*, to form a pair of closed cavities 241 and 241*a*. Like cavities 43, 44, 45 and 46 of the first embodiment, cavities 241 and 241*a* are, preferably, filled with a mixture of distilled water and ethyl alcohol to resist rapid changes in temperature.

As with the first embodiment, thermoelectric modules 223 and heat sink spacers 225 are held in compression between load plates 221, 221*a* and heat sinks 227. Type 44 or other suitable heat transfer compound is interposed between the opposing surfaces of 239 (or 239*a*), thermoelectric modules 223, spacers 225, and heat sinks 227. Heat sink ducts 243 found between plates 239, 239*a* and heat sinks 227 are insulated from plates 239, 239*a* by insulator 245, of the type disclosed above. Heat sinks 227 include fins 247. Heat sinks 227 and covers 228 form heat sink ducts 249.

In operation gaseous $CO_2$ is pumped into system via a conventional pump (not shown) and tubing (also not shown). Because of the convoluted design of load tube 215, as illustrated in FIG. 13, as the $CO_2$ passes through the system it is cooled in a phase like fashion until it emerges from output 219 as a liquid having a temperature of between 0° and 20° F. Further, because the $CO_2$ is cooled by each preceding phase, each succeeding phase of thermoelectric devices is able to pump more heat out of the $CO_2$ until it is liquified and cooled to the desired temperature. For instance, if each straight section of tube 215 represents a phase, the thermoelectric device of phases 1 and 2 (i.e., sections 1 and 2) would remove approximately 50 BTU/hr; the thermoelectrics of phase 3 and 4, approximately 150 BTU/hr; and the thermoelectrics of phase 5, approximately 250 BTU/hr.

As with the first embodiment, heat from the thermoelectric devices is first removed via fluid passing through heat sink ducts 243 and, secondly, by fluid passing through heat sink ducts 249. Ducts 243 and 249 may be interconnected (via structure not illustrated) with the cooling fluid pumped into both via a conventional pump (not shown) and tubing (also not shown) connected to input 229 and output 230. Alternately, ducts 243 and 249 can be connected to separate fluid pumping systems.

Whereas the drawings and accompanying description have shown and described the preferred embodiment of the present invention, it should be apparent to those skilled in the art that various changes may be made in the form of the invention without affecting the scope thereof.

We claim:

1. A thermoelectric heating and cooling system including a first load plate, a heat sink, and one or more thermoelectric devices interconnecting said first load plate with said heat sink to pump heat to or from said load plate, depending upon the direction of current through said thermoelectric devices, wherein said load plate includes a housing having a hollow cavity therein, said cavity filled with a phase change medium which changes temperature slower than said housing to thereby act as a sustaining reservoir to help maintain the desired temperature of said load plate.

2. The system as set forth in claim 1, wherein said hollow cavity is a closed to the environment in which it is used.

3. The system as set forth in claim 2, wherein said phase change medium is a liquid.

4. The system as set forth in claim 3, wherein said liquid is a mixture that includes water and ethyl alcohol.

5. The system as set forth in claim 2, wherein said first load plate is made of material having high thermal conductivity.

6. The system as set forth in claim 2, wherein said first load plate includes first and second plates of material having high thermal conductivity spaced apart by material having low thermal conductivity.

7. The system as set forth in claim 2, further including thermal energy transfer fins secured to said first load plate.

8. The system as set forth in claim 2, further including a second load plate including a housing having a hollow closed cavity therein filled with said phase change medium, and wherein said first and second load plates are connected to form a passage through which passes a fluid which is to be heated or cooled by said thermoelectric devices.

9. The system as set forth in claim 8, further including thermal energy transfer fins secured to said load plates and projecting into said passage.

10. The system as set forth in claim 1, further including means for defining a passage for fluid which is to be heated or cooled by said first load plate, said first load plate thermally coupled to said means for defining said fluid passage.

11. The system as set forth in claim 10, wherein said means for defining said fluid passage is a tube having inwardly directed thermal energy transfer fins therein.

12. The system as set forth in claim 11, further including a second load plate including a housing having a hollow cavity therein, said first and second load plates being configured to surround said tube.

13. In a thermoelectric heating and cooling system including a load plate having first and second exterior surfaces, a heat sink having first and second exterior surfaces, and one or more thermoelectric devices interconnecting said first surface of said load plate with said first surface of said heat sink, wherein said thermoelectric devices are spaced from said heat sink by first spacer means, said first spacer means being formed of material having high thermal conductivity and being in direct contact with both said thermoelectric devices and said first surface of said heat sink, second spacer means interconnecting said heat sink and said load plate to form a spacer duct for the passage of fluid between said heat sink and said load plate, thereby permitting fluid to circulate around said first spacer means.

14. The system as set forth in claim 13, further including means for forcing fluid through said spacer duct.

15. The system as set forth in claim 13, wherein said first spacer means have surfaces which are exposed to the interior of said spacer duct and which are grooved to thereby increase the area of said spacer surfaces exposed to fluid passing through said spacer duct, to thereby increase the amount of heat transferred to or from said spacers by said fluid passing through said spacer duct.

16. The system as set forth in claim 15, wherein said spacer duct has a longitudinal axis and said first spacer means are staggered with respect to said axis to thereby increase the fluid flow across said exposed spacer surfaces.

17. The system as set forth in claim 16, wherein said second spacer means has openings therein along the length of said spacer duct for the escape of fluid from said spacer duct.

18. The system as set forth in claim 13, further including load plate insulation means, said load plate insulation being in contact with said first surface of said load plate, whereby said load plate is insulated from said spacer duct.

19. The system as set forth in claim 18, wherein the surface of said load plate insulation means which faces the interior of said spacer duct is smooth to minimize fluid drag.

20. The system as set forth in claim 18, wherein said load plate insulation means comprises a housing formed of thermal insulation material having a sealed cavity therein, said cavity being at least partially evacuated of air and filled with a gas that has a lower thermal conductivity than air.

21. The system as set forth in claim 20, wherein said gas is $CO_2$.

22. The system as set forth in claim 13, further including a heat sink housing means, said heat sink housing means and said second heat sink surface forming a heat sink duct for channeling fluid across said second heat sink surface.

23. The system as set forth in claim 22, further including means for forcing fluid through said heat sink duct and across said second heat sink surface.

24. The system as set forth in claim 23, wherein said second heat sink surface includes fins projecting in to said heat sink duct to facilitate heat transmission between said heat sink and the fluid passing through said heat sink duct.

25. The system as set forth in claim 23, wherein said means for forcing fluid through said heat sink duct is a fan.

26. The system as set forth in claim 23, wherein the portion of said heat sink housing means positioned between said means for forcing fluid through said heat sink duct and said heat sink includes means for increasing the velocity of said fluid across said heat sink.

27. The system as set forth in claim 23, wherein said heat sink duct and said spacer duct are interconnected, and wherein said means for forcing fluid through said heat sink duct also forces fluid through said spacer duct.

28. The system as set forth in claim 27, wherein the portion of said heat sink housing means positioned between said means for forcing fluid through said heat sink duct and said heat sink includes means for increasing the velocity of said fluid across both said heat sink and said first spacer means.

29. The system as set forth in claim 13, further including a load plate duct means thermally coupled to said second exterior surface of said load plate, said load plate duct means being connectable to the environment whose temperature is to be controlled by said system, and means interconnecting said load plate duct means with said spacer duct, whereby at least some fluid may be drawn from said controlled environment and through said spacer duct to increase the cooling efficiency of said first spacer means.

30. The system as set forth in claim 29, further including a first fan for forcing fluid through said load plate duct, a second fan for forcing fluid through said spacer duct, and duct means interconnecting said second fan to said spacer duct, said means for interconnecting being located in said load plate duct means and said interconnecting duct means upstream of said first and second fans.

31. The system as set forth in claim 30, wherein said means for interconnecting includes a deflector plate which projects into said interconnecting duct.

32. In a thermoelectric heating and cooling system including a load plate, a heat sink and one or more thermoelectric devices interconnecting said load plate with said heat sink, a load plate duct connected to said load plate, a heat sink duct connected to said heat sink, means for forcing fluid through said load plate duct, means for forcing fluid through said heat sink duct, and means for interconnecting said load plate duct and said heat sink duct.

33. In a thermoelectric heating and cooling system including a load plate having first and second exterior surfaces, a heat sink having first and second surfaces, and one or more thermoelectric devices interconnecting said first surface of said load plate with said first surface of said heat sink, wherein said thermoelectric devices are spaced from said heat sink by spacer means, and wherein said load plate includes a housing having a hollow cavity therein, said cavity filled with a fluid which changes temperature slower than said housing to thereby act as a sustaining phase change reservoir to help maintain the desired temperature of said load plate.

34. The system as set forth in claim 33, wherein said hollow cavity is a closed to the environment in which it is used.

35. The system as set forth in claim 34, wherein said liquid includes water.

36. The system as set forth in claim 35, wherein said spacer means are formed of material having high thermal conductivity and are in direct contact with both said thermoelectric devices and said heat sink, and further including second spacer means interconnecting said heat sink and said load plate to thereby form a spacer duct for the passage of fluid between said heat sink and said load plate, thereby permitting fluid to circulate around said spacers.

37. The system as set forth in claim 36, further including a heat sink housing means, said heat sink housing means and said second heat sink surface forming a heat sink duct for channeling fluid across said second heat sink surface.

38. The system as set forth in claim 37, further including a load plate duct means thermally coupled to said second exterior surface of said load plate, said load plate duct means being connectable to the environment whose temperature is to be controlled by said system, and means interconnecting said load plate duct means with said spacer duct, whereby at least some fluid may be drawn from said regulated environment and through said spacer duct.

* * * * *